US008672414B2

(12) United States Patent
Junker et al.

(10) Patent No.: US 8,672,414 B2
(45) Date of Patent: Mar. 18, 2014

(54) METHOD FOR CONTROLLING LONGWALL MINING OPERATIONS

(75) Inventors: Martin Junker, Rheinberg (DE); Armin Mozar, Hamm (DE)

(73) Assignee: RAG Aktiengesellschaft (DE)

( * ) Notice: Subject to any disclaimer, the term of this patent is extended or adjusted under 35 U.S.C. 154(b) by 637 days.

(21) Appl. No.: 12/918,473

(22) PCT Filed: Feb. 19, 2008

(86) PCT No.: PCT/EP2008/001262
§ 371 (c)(1),
(2), (4) Date: Aug. 19, 2010

(87) PCT Pub. No.: WO2009/103303
PCT Pub. Date: Aug. 27, 2009

(65) Prior Publication Data
US 2011/0049964 A1 Mar. 3, 2011

(51) Int. Cl.
*E21C 35/08* (2006.01)
*E21D 9/093* (2006.01)
*E21D 23/16* (2006.01)

(52) U.S. Cl.
USPC ..... 299/1.7; 299/33; 405/302

(58) Field of Classification Search
USPC ..... 299/1.7, 1.6, 31, 33; 405/302
See application file for complete search history.

(56) References Cited

U.S. PATENT DOCUMENTS

| | | | | |
|---|---|---|---|---|
| 4,228,508 | A | 10/1980 | Benthaus | |
| 4,427,321 | A | 1/1984 | Weirich et al. | |
| 4,755,084 | A | 7/1988 | Peters et al. | |
| 4,887,935 | A | 12/1989 | Koppers et al. | |
| 5,423,638 | A * | 6/1995 | Merriman | 405/292 |
| 5,743,679 | A | 4/1998 | Gottschlich | |
| 6,056,481 | A | 5/2000 | Watermann et al. | |
| 2003/0075970 | A1 * | 4/2003 | Hainsworth et al. | 299/1.6 |
| 2009/0035072 | A1 * | 2/2009 | Koenig et al. | 405/288 |
| 2009/0084545 | A1 * | 4/2009 | Banerjee et al. | 166/250.15 |

FOREIGN PATENT DOCUMENTS

| | | |
|---|---|---|
| DE | 3620880 | 6/1987 |
| GB | 2090896 | 7/1982 |

* cited by examiner

*Primary Examiner* — David Bagnell
*Assistant Examiner* — Kyle Armstrong
(74) *Attorney, Agent, or Firm* — Berenbaum Weinshienk PC; Robert W. Becker

(57) ABSTRACT

A method for controlling a longwall mining operation, including a face conveyor, at least one extraction machine, and a hydraulic shield support, in underground coal mining. Using inclination sensors disposed on at least three of the four main components of each shield support frame, such as floor skid, gob shield, support connection rods, and gob-side region of the top canopy, the inclination of the shield components relative to horizontal is ascertained in the direction of step. In a computer, the ascertained inclination data is compared with base data stored in the computer that defines the geometrical orientation of the components and their movement during stepping. From the comparison, a respective height of the shield support frame, at the forward end of the top canopy, is calculated as a measure for the face opening.

19 Claims, 6 Drawing Sheets

13
10
α
14
12
11

10
13
12
14
11

10
13
14
11
12

METHOD FOR CONTROLLING LONGWALL MINING OPERATIONS

BACKGROUND OF THE INVENTION

The instant application should be granted the priority dtaes of Feb. 19, 2008, the filing date of the International patent application PCT/EP2008/001262.

The invention relates to a method for controlling longwall operations in underground coal mining having a face conveyor, at least one extraction machine, and a hydraulic shield support.

The control of longwall operations during face advancing generally is concerned with the best possible exploitation of the provided machine capacities while avoiding shutdowns, an automation of the required control procedures being provided if possible, in order to avoid flawed human decisions. Approaches to automation of the control are in development and/or already in use, such as sensory boundary layer detection/control, learning step methods, recognition and control of the advancing path of the hydraulic supports, automated stepping of the hydraulic supports, and automatic maintenance of a predefined target inclination of the face conveyor.

A problem in the automation of longwall controllers is, inter alia, to ensure that a sufficient height perpendicular to the bed, i.e., a sufficient face opening, is provided in the forward area of the top canopy of each individual shield support frame, in order to ensure the extraction machine travels past undisturbed, because every collision of the extraction machine with the top canopy of the shield support frame as a result of a face opening which is too small results in corresponding operational disturbances and/or also damage of the operating means.

The invention is therefore based on the object of disclosing a method of the type cited at the beginning, which gives notice of a possible collision between the extraction machine and the shield support frame and thus helps to avoid corresponding collisions.

SUMMARY OF THE INVENTION

The achievement of this object results, including advantageous embodiments and refinements of the invention, from the content of the claims which are appended to this description.

Specifically, the invention provides a method in which the inclination of the shield components in relation to the horizontal in the step direction is ascertained using inclination sensors attached to at least three of the four main components of each shield support frame, such as floor skid, gob shield, supporting connection rods, and gob-side area of the top canopy, and the particular height of the shield support frame perpendicular to the bed at the forward end of the top canopy is calculated as a measure of the face opening from the measured data in a computer unit by comparison with base data, which are stored therein and define the geometric orientation of the components and their movement during the stepping.

The advantage is primarily connected to the invention that solely because of the geometric conditions during use of the shield support frame, which are to be ascertained with comparatively little effort, the face opening existing at the forward end of the top canopy is to be ascertained in the form of the height perpendicular to the bed ascertained for this position; as long as this face opening corresponds to or is somewhat greater than the face opening produced by the extraction machine during its planned operation, the risk of a collision of the extraction machine with the relevant shield support frame does not exist. If the continuous monitoring of the face opening at the front end of the top canopy results in a face opening which is too small, an imminent collision can be counteracted by appropriate control of the extraction machine. In a further advantageous way, the data acquired at individual shield support frames provide additional information about the behavior of individual sections of the longwall front or the entire longwall front during progressive face advancing, which allows integral process control of the particular mining operation.

It can thus be concluded from the relationship of the face opening to the mineral deposit data applicable for the particular mining operation, such as the seam thickness, which possibly changes over the length of the longwall, whether the danger of placement of the overlying strata on the shield support frames exists or whether the upper adjustment limit of the shield support frames is about to be exceeded in the case of desired automatic operation. The danger of placement of the overlying strata exists if, when convergence is beginning, the shield props are entirely retracted and, because of the overlying strata, which then applies a load, the shield support frame is blocked and can no longer be advanced; a further possibility is that the steel structure at the lower adjustment limit in the lemniscate mechanism of the shield support frame or in the joint top canopy/gob shield is blocked and can then also no longer be advanced. The above-mentioned hazard moments apply in particular for the passage through saddles or troughs in the course of the seam, which can be taken into consideration by corresponding setup of the extraction height of the particular extraction machine used. Furthermore, the corresponding face opening data may give information about a possible collapse from the overlying strata, the occurrence of seam tapering, the "driving on coal" of the extraction machine, and/or a possible footwall cut of the extraction machine.

According to an exemplary embodiment of the invention, it is provided that shield support frames in a construction having a divided floor skid are also used, in which the step mechanism of the shield support frame is situated between the two single skids, so that the two single skids of the shield support frame may be retracted separately from one another, in contrast to skids which are connected to one another, whereby the so-called elephant step is possible as a step control. In such shield support frames, which are used in particular in the lesser seam thicknesses, which are typical for planing operations, one inclination sensor is situated on each of the two single skids.

For this purpose, it can be provided that for each of the two single skids, the particular shield height is calculated from the measured angles of inclination for the top canopy, the gob shield, and for the right and the left single skids of the shield support frame, it being able to be provided that the shield height ascertained for the shield support frame is calculated from the mean value of the shield height values calculated for the two single skids. However, for the recognition of problems caused by prop placement, or for a judgment of whether the upper adjustment limit has been reached in the shield support frame, an individual analysis of the shield height for the right and the left shield halves is required on the basis of the angles of inclination ascertained on the single skids.

In that it is provided according to an exemplary embodiment of the invention that the heights perpendicular to the bed within the shield support frame in the area of the contact point of the prop on the top canopy and in the area of the joint between top canopy and gob shield are additionally calculated in the computer unit, the advantage results therefrom that indications of the behavior of the individual shield support frame during multiple sequential step cycles may be derived via the height location of the top canopy over its entire extension, whether the shield structure climbs or descends, for example.

In that it is provided according to an exemplary embodiment of the invention that the inclination sensors attached to the shield components are placed at positions having minimal bending angle of the components, this is used for minimization of measuring errors under load action.

Because the height ascertainment is to be performed with the greatest possible precision and height loss errors may occur upon load of the individual shield support frames because of a bending strain of the individual components of the shield support frames, it is provided according to an exemplary embodiment that the internal pressure of the props of the step support frame is ascertained using pressure sensors. On the basis of standard behavior previously established in the case of the relevant shield support frames in various load states, a correction factor, which considers the bending strain in practical use of the longwall support frames, can be applied as a function of the particular load absorbed in operation, as provided according to an exemplary embodiment of the invention.

According to an exemplary embodiment of the invention, the inclination of the top canopy to the horizontal transversely to the step direction is ascertained via the inclination sensor attached to the top canopy of the shield support frame. It is thus possible to establish during the sequence of the movements of a shield support frame whether the shield support frame in the sequence is still in the guide area of covering for the gap to adjacent shield support frames. If two adjacent shield support frames have large differences in the height or the angle, an increased risk exists that during automatic advance, the shield support frame will move out of the bracing of the mutual gap coverings and then be knocked down. The retraction height of the top canopy can then be reduced upon recognition of a critical overlap situation, or the top canopy can be oriented in the bracing with adjacent shield support frames before the step cycle, or the step cycle can be aborted before the renewed placement of the relevant shield support frame, if this shield support frame has moved out of the bracing; a correction is then given if needed.

If a disc shearer loader, which is to be controlled precisely in its extraction work, is used as an extraction machine, it is provided according to an exemplary embodiment of the invention that in the case of an extraction machine implemented as a disc shearer loader, the cutting heights of the leading disc which executes the upper partial cut and the disc which executes the lower partial cut are ascertained by sensors which detect the position of the disc support arms and as the extraction machine travels past each shield support frame, the total disc cutting height is related to the face opening ascertained by computer at the relevant shield support frame. An adaptation of the travel of the extraction machine through the longwall to the position of the individual shield support frames of the shield support used is thus possible.

Furthermore, it is provided according to an exemplary embodiment of the invention that the disc cutting height, which is ascertained for a position of the extraction machine assigned to a shield support frame, is subsequently assigned in the course of a location-synchronized analysis of the face opening established with chronological advance delay of the top canopy of the assigned shield support frame. The circumstance is thus considered that the face opening produced by the extraction machine is only reached one to two advance steps later by the tip of the top canopy of the assigned shield support frame, which is referred to as an advance delay. For the comparative judgment of the face opening produced by the extraction machine and the face opening supported by the shield support, only the height data at the same position may be used. For this purpose, historical cutting height data are set in the addressed computer unit and placed at the same spatial coordinates in the comparison with the shield data, as soon as the shield support frame has reached the corresponding spatial coordinates. This procedure can also be referred to as location-synchronized analysis.

The control method according to the invention is further improved in that the inclination of face conveyor and/or extraction machine to the horizontal in the step direction of the shield support frame is ascertained using inclination sensors attached to face conveyor and/or extraction machine. Situating one inclination sensor on the extraction machine is sufficient. Although the extraction machine, which travels on the face conveyor and is guided thereon, forms a type of unit with the face conveyor, to improve the precision of the control, it can be expedient to also detect the inclination of the face conveyor via an inclination sensor situated thereon. If necessary, situating an inclination sensor solely on the face conveyor is also sufficient for the purpose of the control.

Specifically, it can be provided that the angle of inclination of face conveyor and/or extraction machine is set in a ratio to the angle of inclination ascertained on the floor skid of the shield support frame and/or on the top canopy and the differential angle calculated therefrom is incorporated in the calculation of the face opening resulting during multiple sequential step cycles of the shield support frame. The advantage is connected thereto that cutting across seam troughs or seam saddles can be controlled better, because the behavior of the longwall front is recognizable early, so that influence can be taken on the location and cross-section of the face opening by timely commencement of the extraction activity.

According to an exemplary embodiment of the invention, it is provided that the height values, which describe the geometry of the shield support frame, at the forward end of the top canopy, in the area of the contact point of the prop on the top canopy, and in the area of the joint between top canopy and gob shield are detected over the time axis and convergence, caused by the rock which applies the load, is determined from changes of the measured values over the time axis. Convergence is the reduction of the height of the relevant face opening in relation to the starting height. The convergence of a single frame from step to step can be determined from the individual shield support frames at every position at which the shield support frame was placed. In this case, in addition to the absolute convergence during the standing time of a shield support frame, the time convergence curve is also decisive. The observation of the convergence curve allows early recognition of effect zones of tectonic irregularities or mining edges and optimization of support and extraction work with respect to the particular current conditions. It has been established that the change of the geometry of the face opening results in a significantly better picture about the occurring convergence than the observation of the prop internal pressure, because the props of the individual shield support frames are protected against excessively high pressures by online pressure limiting valves and a convergence is thus not detectable over the time axis if preset pressure levels are exceeded.

It can be provided that the convergence is represented in the form of convergence parameters with respect to the face opening at the forward end of the top canopy, the inclination of the top canopy to the horizontal in the step direction, the sinking of the prop carrying the top canopy, and the end of the top canopy.

According to one exemplary embodiment of the invention, it is provided that the position of the shield support frame with respect to the introduction of the advance support forces is determined from the convergence parameters and/or the inclination of the top canopy, in that the location of the gob edge over the top canopy is concluded from the position of the top canopy to the course of the canopy. In this way, positions of the shield support frame which are unfavorable for advance technology may be recognized and considered and corrected appropriately during following step cycles.

According to one exemplary embodiment of the invention, it is provided that acceleration sensors are used as the inclination sensors, which detect the angle of the acceleration sensor in space via the deviation from Earth's gravity. It can be provided, to eliminate errors caused by the vibrations of the components used, that the measured values ascertained by the acceleration sensors are checked and corrected using a suitable damping method.

In a way known per se, it can be provided that the position of the individual shield support frames is made optically visible in a display unit, it being able to be expedient if deviations from predefined target values, which are recognized as forming a risk, are shown in the display unit in a conspicuous color.

BRIEF DESCRIPTION OF THE DRAWINGS

Exemplary embodiments of the invention, which are described hereafter, are shown in the drawing. In the figures.

DESCRIPTION OF SPECIFIC EMBODIMENTS

Figure 1:
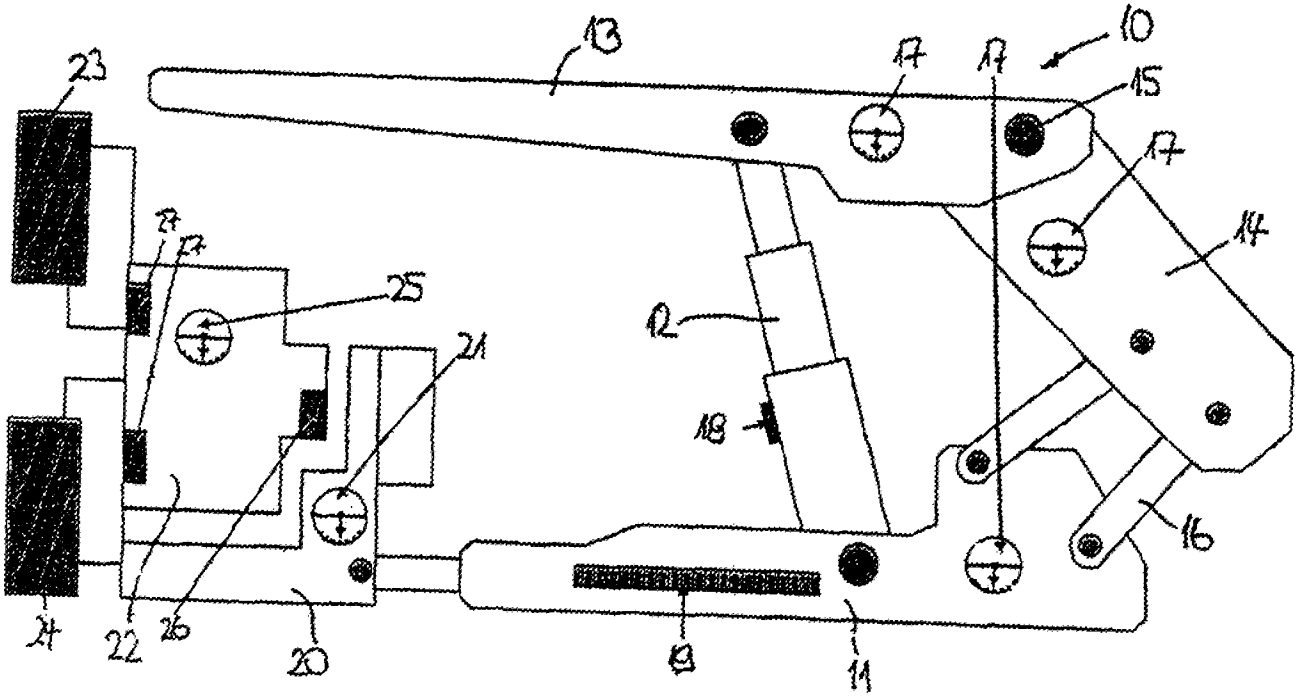
FIG. 1 shows a shield support frame having inclination sensors situated thereon in connection with a face conveyor and a disc shearer loader, which is used as an extraction machine, in a schematic side view.

The longwall equipment shown in FIG. 1 primarily comprises a shield support frame 10 having a floor skid 11, on which two props 12 are attached in a parallel configuration, of which only one prop is recognizable in FIG. 1, which carries a top canopy 13 on its upper end. While the top canopy 13 protrudes in the direction of the extraction machine (to be described hereafter) at its front (left) end, a gob shield 14 is linked on the rear (right) end of the top canopy 13 using a joint 15, the gob shield being supported by two supporting connection rods 16, which rest on the floor skid 11 in the side view. In the exemplary embodiment shown, three inclination sensors 17 are attached to the shield support frame 10, one inclination sensor 17 on the floor skid 11, one inclination sensor 17 in the rear end of the top canopy 13 in proximity to the joint 15, and one inclination sensor 17 on the gob shield 14. As is not shown in greater detail, an inclination sensor can also be provided on the fourth movable component of the shield support frame 10, the connection rods 16, three inclination sensors having to be installed of the four possible inclination sensors 17 in each case, in order to determine the position of the shield support frame in a working area using the inclination values ascertained therefrom. Furthermore, the inclination sensor 17 shown in FIG. 1 in the rear area of the top canopy 13 can also be moved into the front area of the canopy, if a protected space is available for this purpose in the canopy profile. The invention is thus not restricted to the concrete configuration of the inclination sensors shown in FIG. 1, but rather comprises all possible combinations of three inclination sensors on the four movable components of the shield support frame.

Figure 2:
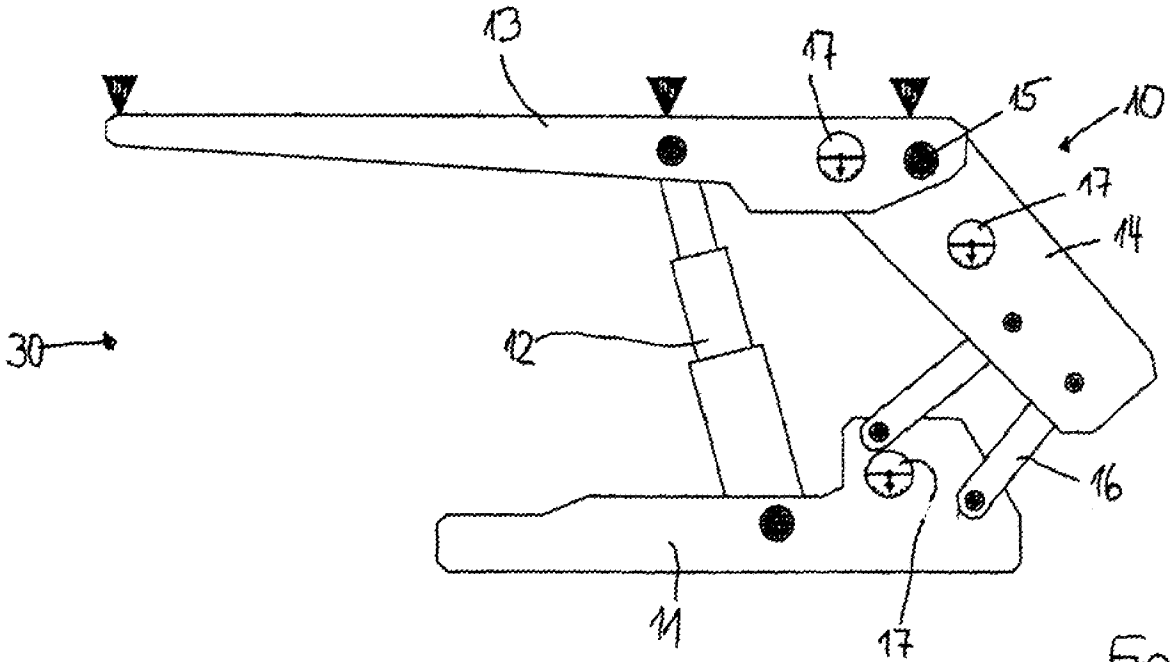
FIG. 2 shows the shield support frame from FIG. 1 in an individual illustration having a designation of the assigned height measurement points.
Figures 8A, 8B, 8C:
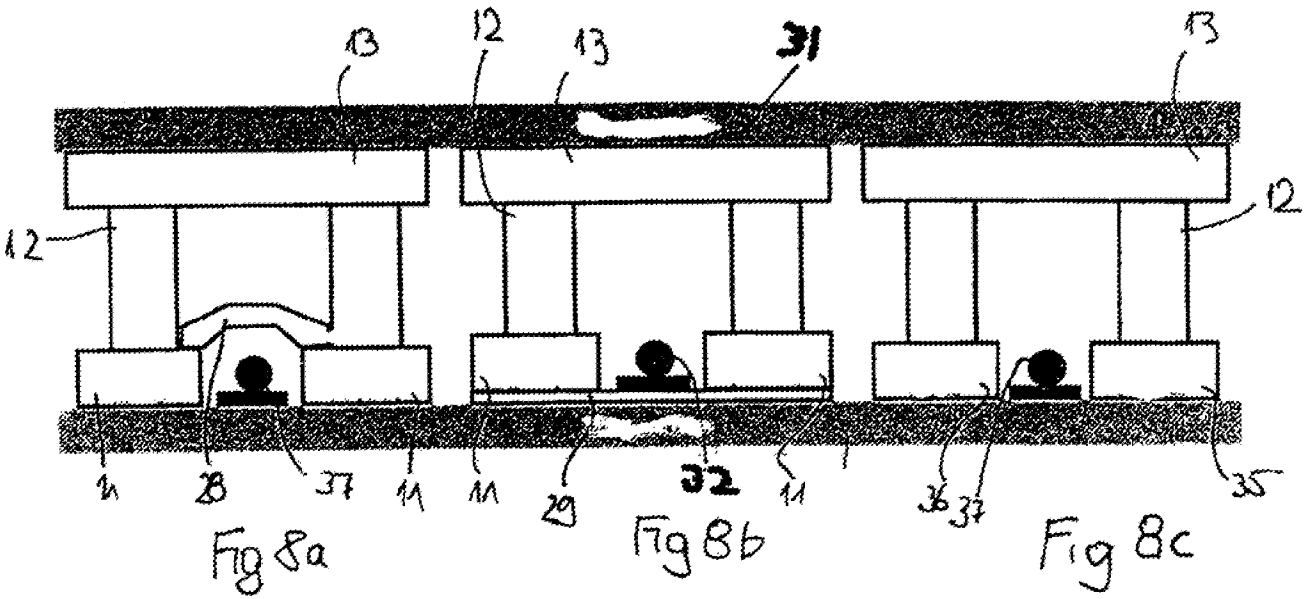

As shown in FIGS. 8*a* through 8*c*, the shield support frame 10, which is shown in FIGS. 1 and 2 in a side view, can fundamentally have three constructions with respect to its floor skid. As first shown in FIG. 8*a*, the floor skid 11 comprises two partial skids, which are fixedly connected to one another via a fixed steel construction 28, however, so that a so-called "tunnel skid" results. This tunnel skid does have better vertical mobility, but higher surface pressures occur and thus a higher tendency toward sinking of the two partial skids into the footwall.

Alternatively thereto, according to FIG. 8*b*, the floor skid can be implemented having two partial skids, which are connected to one another via a floor plate 29, so that a larger bearing surface for the floor skid results. The surface pressure is thus reduced and thus the tendency that the shield support frame presses into the footwall in particular in the area of the skid tips. However, this construction restricts the mobility for rapid changes of the shield height, because in particular in the event of a rapid increase of the shield height, the step mechanism 37 cannot follow a rapidly descending face conveyor, because the step mechanism presses against the closed floor plate 29, which limits the possibility of the height adaptation.

Finally, an embodiment is shown in FIG. 8*c*, which is preferably used in planing operations in the event of a small seam thickness, for example less than 1.5 m. In this embodiment, separate single skids 35 and 36 are provided, between which the step mechanism 37 is situated so that the right single skid 35 in the step direction can be raised independently of the left single skid 36 in the step direction. This separation of the single skids 35 and 36 allows the stepping or advancement of the shield support frame 10 in the so-called elephant step, using which sinking of the two single skids 35 and 36 into the footwall 32 and collection and pushing of debris in front of the single skids 35, 36 can be counteracted. Debris of this type would not flow away rapidly enough in the direction of the gob field under specific operating conditions without appropriate countermeasures and would increasingly obstruct or, in an advanced stage, even prevent the stepping action. During the stepping action, the shield support frame 10 is initially relieved by extending its two props 12. However, the prop connected to a single skid is subsequently retracted, so that the relevant single skid can be raised again and can slide on the debris lying on the footwall as the shield support frame advances. When the shield is placed, the relevant single skid stands on the elevated level. During the next stepping action, the same cycle is performed with the sides reversed using the other single skid, so that the individual stepping actions complete a type of "trampling step". Using the same technique, it is also possible to raise a single skid sunken into the footwall back to the footwall level.

The shield support frame 10 shown in FIG. 1 is fastened to a face conveyor 20, which also has an inclination sensor 21, so that in general data with respect to the conveyor location can also be obtained here in regard to the control of the longwall equipment. An extraction machine in the form of a disc shearer loader 22 having an upper disc 23 and a lower disc 24 is guided on the face conveyor 20, an inclination sensor 25 also being situated in the area of the disc shearer loader 22, as well as a sensor 26 for detecting the particular location of the disc shearer loader 22 in the longwall and reed bars 27 for measuring the cutting height of the disc shearer loader 22. The measuring equipment of the longwall equipment is supplemented by the configuration of sensors 18 on the props 12, using which the change of the height location of the top canopy 13 is possible by establishing the failure height of the prop 12. Furthermore, a distance measuring system 19 is integrated in the floor skid 11, using which the particular step stroke of the shield support frame 10 in relation to the face conveyor 20 can be established. As already noted, the configuration of the inclination sensor 21 on the face conveyor 20 is not absolutely necessary, if the inclination sensor 25 is set up on the disc shearer loader 22. In such a case, the inclination sensor 21 can additionally be provided for improving the measuring precision, however.

As indicated in FIG. 2, on the basis of the known kinematics of the shield support frame 10, the heights $h_1$, $h_2$, and $h_3$ can be ascertained depending on the position of floor skid 11, gob shield 14, and top canopy 13 to one another, the height $h_1$ applying for ascertaining the height perpendicular to the bed of the face opening 30, while the height $h_2$ forms a measure of a possible excess height when the shield support frame is completely extended or for a placement danger, while the height $h_3$ can be used to observe the convergence. The heights $h_1$, $h_2$, and $h_3$ can be ascertained on the basis of the measured values of the inclination sensors 17, the values measured by the sensors 17 being compared in a computer unit (not shown in greater detail) to the base data stored therein for the geometrical orientation of the components and their movement behavior to one another. For this purpose, it is provided that the individual shield support frames 10 are calibrated after their installation in the longwall equipment, in that the top canopy 13, the gob shield 14, and the floor skid 11 are calibrated using manual inclinometers in the installed state and the measured values are input into the corresponding controller of the shield support frame 10. If the height values $h_1$, $h_2$, and $h_3$ are displayed in the shield controller, these height values can be re-measured using measuring tapes and the inclination sensors can subsequently be calibrated accordingly.

In that changes in the inclinations of the components may also occur because of a bending strain of the components upon occurring load, it can be provided that corresponding angle errors or errors in the ascertainment of the height values are considered by introducing a load-dependent error coefficient, in that the load occurring in operation is performed using appropriately provided sensors via acquisition of the prop internal pressure of the props 12 of the shield support frame 10 and the particular correction factor is calculated on the basis of standard values for the behavior of the components of the shield support frame 10 at corresponding loads.

Figures 3A, 3B, 3C:
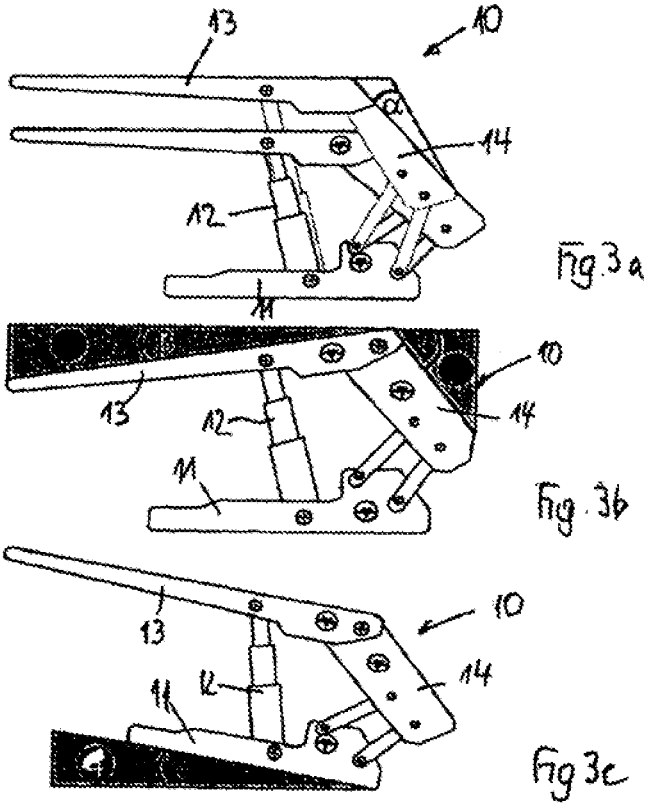
FIGS. 3*a-c* show the shield support frame from FIG. 1 in various geometric positions of its components to one another.

As shown in FIGS. 3*a*, 3*b*, and 3*c*, the adjustment of the gob shield 14 can be detected via the detection of the change of the angle $\alpha$ (FIG. 3*a*). The angle change in the area of the top canopy 13 can be ascertained via the detection of the angles $\beta$ and $\epsilon$ according to FIG. 3*b*, the angle changes of the above-mentioned angles indicating the behavior of the shield support frame 10 over multiple step cycles in the sense of climbing or descending. The angle $\gamma$, which is obvious from FIG. 3*c*, shows the position of the floor skid 11 on the footwall. It results from the above requirements that the inclination sensors 17 used are to have a measuring range of at least 120 to 180°, inclination sensors 17 having a measuring range from 0 to 360° being expedient in particular.

Figure 4:
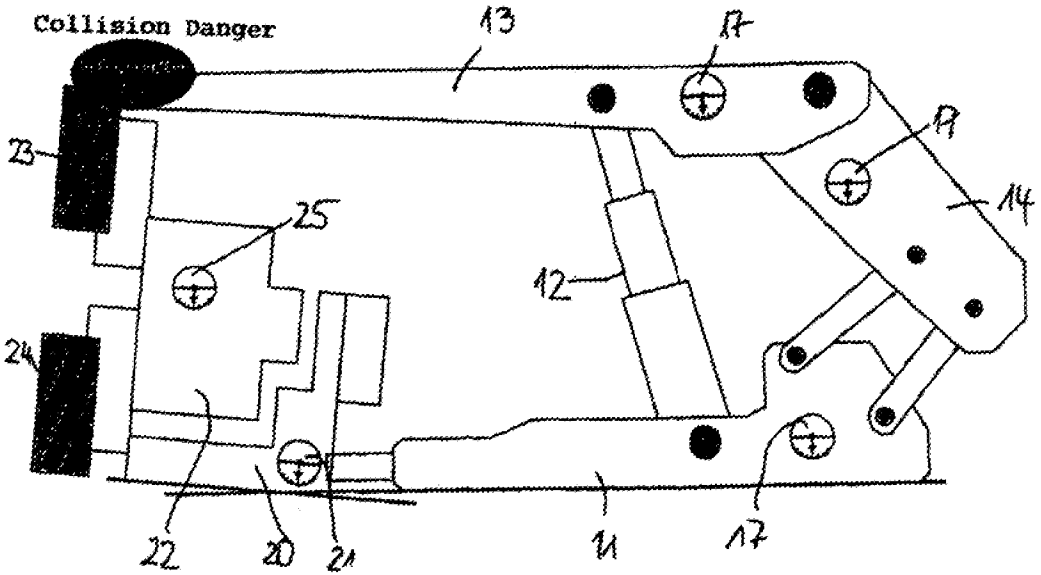
FIG. 4 shows the longwall mining equipment according to FIG. 1 in another operating situation.

As shown once again in FIG. 4, it is expedient to also equip the face conveyor 20, on which the particular individual shield support frames 10 of the longwall equipment are attached, and also the extraction machine 22, which is guided on the face conveyor 20, in the form of a disc shearer loader 22 having an upper disc 23 and a lower disc 24, with corresponding inclination sensors, so that by incorporating these inclination values, the total ascertained disc cutting height of the disc shearer loader 22 can be set in relation to the face opening 30 provided by the shield support frames 10. In the exemplary embodiment shown in FIG. 4, it is recognizable that because of climbing of face conveyor 20 with disc shearer loader 22, a collision danger results in the area of the forward edge of the top canopy 13.

Figure 5:
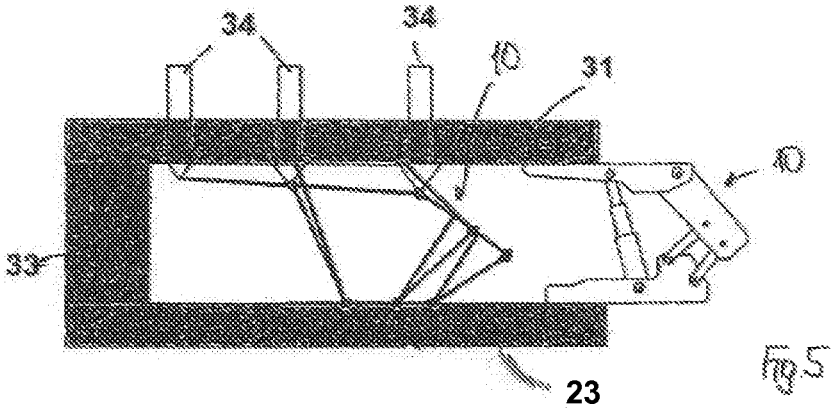
FIG. 5 shows a shield support frame according to FIG. 1 during the convergence action in a schematic view.

As results from FIG. 5, the height values $h_1$, $h_2$, and $h_3$ can also give information about the convergence arising unavoidably in underground mining operation due to load of the overlying strata 31 on the top canopy 13 of the shield support frame 10, which stands on the footwall 32, as indicated by the load arrows 34. The coal face 33 is also schematically shown in FIG. 5 between the overlying strata 31 and the footwall 32.

Figure 6:
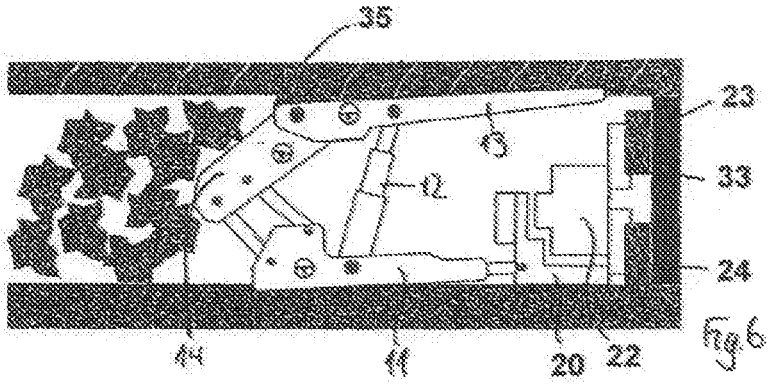
FIG. 6 shows the shield support frame from FIG. 4 having a good gob edge location.
Figure 7:
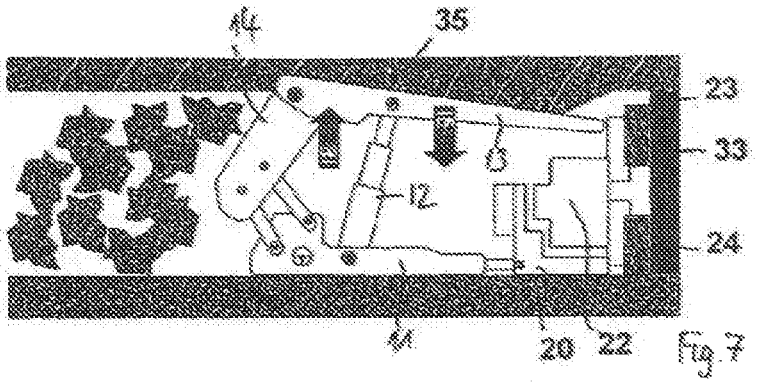
FIG. 7 shows the shield support frame from FIG. 4 having a poor gob edge location, FIGS. 8*a-c* each show a shield support frame from FIG. 2 having various embodiments of its floor skid in a front view.

Conclusions about the location of the gob edge are possible via the observation of the geometry of the particular shield support frame 10 in connection with the occurring convergence, as results from FIGS. 6 and 7.

In the position of the shield support frame 10 shown in FIG. 6, which is ascertained on the basis of the values of the inclination sensors 17, the gob edge 35 is in the rear area of the top canopy 13, which means that the carrying capacity of the shield support frame 10 is optimally exploited, because the introduction of the advance support forces occurs in the area of the shield support frame in which the best possible effect can be achieved with respect to the control of the overlying strata. Possible rock cushions forming on the surface of the top canopy 13 may be stripped off during stepping of the shield support frame 10. The floor skid stands slightly rising and can thus slide well on debris possibly forming on the footwall 32. The result of a position of this type of the shield support frame 10 is that rock collapse is hardly to be expected as the support advances, so that optionally automated and smooth operation of the longwall equipment is also possible.

In contrast thereto, the positions of top canopy 13 and gob shield 14 in the shield support frame 10 shown in FIG. 7 indicate that the gob edge 35 is placed too far forward with respect to the top canopy 13, for example in the area of the linkage of the prop 12. The gob-side end of the top canopy 13 presses upward because of a lack of a buttress in the overlying strata 31 in this way, so that the forward tip of the top canopy 13 is directed downward. If such a position of the top canopy 13 is recognized via the data delivered by the inclination sensors 17, it can be counteracted appropriately, so that the disadvantages connected to such a shield control are avoided.

As not shown in greater detail, it is also possible using the inclination measured data, which is obtained on the individual shield support frames 10 and also on face conveyor 20 and extraction machine 22, to acquire the behavior of the longwall mining equipment as a whole over the entire length of the longwall. For example, if deviations in the extraction and support work result in individual areas of the longwall to other areas of the longwall because of geological anomalies such as saddle or trough areas, for example, the corresponding problem zones are immediately visible in the monitoring, so that in these areas the extraction and advance work can be adapted accordingly in a targeted manner.

The features of the subject matter of this application disclosed in the above description, the claims, the abstract, and the drawing may be essential both individually and also in arbitrary combinations with one another for the implementation of the invention in its various embodiments.

The specification incorporates by reference the disclosure of International application PCT/EP 2008/001262, filed Feb. 19, 2008.

The present invention is, of course, in no way restricted to the specific disclosure of the specification and drawings, but also encompasses any modifications within the scope of the appended claims.

The invention claimed is:

1. A method for controlling a longwall mining operation in underground coal mining, including the steps of:

providing a face conveyor;

providing a disc shearer loader as an extraction machine;

providing a hydraulic shield support frame that includes, as main components, a floor skid arrangement, a gob shield, a top canopy, and support connection rods;

disposing inclination sensors on at least three of the group consisting of said floor skid arrangement, said gob shield, said support connection rods, and a gob-side region of said top canopy;

ascertaining from said inclination sensors an inclination of those components of said shield support frame provided with said inclination sensors relative to a horizontal in a direction of movement;

in a computer, comparing ascertained inclination data with base data stored in the computer that defines the geometrical orientation of said last-mentioned components and their movement during stepping;

from said comparison, calculating a respective height of said shield support frame, perpendicular to a bed of said shield support frame, at a forward end of said top canopy, as a measure for a face opening;

setting the height of the face opening calculated by the computer in relation to an overall disc cutting height of the disc shearer loader as said disc shearer loader travels past said shield support frame;

wherein overall cutting height is given by the cutting heights of a leading one of the discs, which carries out an upper partial cut, and of one of the discs that carries out a lower partial cut, and wherein the cutting heights of the discs are ascertained on the basis of sensors that detect the position of the disc support arms.

2. A method according to claim 1, wherein said floor skid arrangement is a divided floor skid that includes two individual skids, further wherein a step mechanism is disposed between said two individual skids, and wherein a respective one of said inclination sensors is disposed on each of said individual skids.

3. A method according to claim 2, wherein for each of said two individual skids a respective shield height is calculated from measured angles of inclination for said top canopy, said gob shield, and for each of said individual skids.

4. A method according to claim 3, wherein the shield height ascertained for said shield support frame is calculated from the mean value of the shield height values calculated for said two single skids.

5. A method according to claim 1, which includes the further step of calculating, in the computer, heights within said shield support frame, perpendicular to the bed of said shield support frame, in the region of a point of contact of a prop on said top canopy and in the region of an articulated joint between said top canopy and said gob shield.

6. A method according to claim 1, wherein said inclination sensors disposed on components of said shield support frame are placed on locations of said components having the greatest rigidity and therefore, minimal bending angles.

7. A method according to claim 1, wherein said shield support frame is further provided with props, and wherein pressure sensors are provided for determining an internal pressure of said props.

8. A method according to claim 7, wherein as a function of the load absorption of said shield support frame, which is represented by the internal pressure of said props, a bowing of said components of said shield support frame, which corresponds to the ascertained load, and that is in the form of a load-dependent error compensation, is incorporated into the calculation heights.

9. A method according to claim 1, which includes the step of ascertaining an inclination of said top canopy relative to a horizontal transverse to said direction of step by means of one of said inclination sensors disposed on said top canopy.

10. A method according to claim 1, wherein a disc cutting height ascertained for a position of said at least one extraction machine associated with said shield support frame is assigned in the course of a location-synchronized analysis of the face opening subsequently established for this position with chronological advance delay of said top canopy of said shield support frame.

11. A method according to claim 1, wherein inclination of said face conveyor and/or said at least one extraction machine relative to the horizontal in the direction of step of said shield support frames is ascertained by means of further inclination sensors disposed on said face conveyor and/or said at least one extraction machine.

12. A method according to claim 11, wherein the angle of inclination of said face conveyor (20) and/or said at least one extraction machine is set in a relationship to the angle of inclination ascertained at said floor skid arrangement and/or at said top canopy, and wherein the differential angle calculated therefrom is incorporated into the calculation of the face opening established during multiple successive step cycles of said shield support frame.

13. A method according to claim 1, wherein the height values which describe the geometry of said shield support frame, at the forward end of said top canopy, in the region of the contact point of a prop on said top canopy, and in the region of an articulated joint between said top canopy and said gob shield, are acquired over a time axis, and a convergence caused by rock that applies a load is determined from changes of the measured values over the time axis.

14. A method according to claim 13, wherein said convergence is represented in the form of convergence parameters based on the face opening at said forward end of said top canopy, on the inclination of said top canopy relative to the horizontal in the direction of movement, on the sinking of a prop that carries said top canopy, and on a gob-side end of said top canopy.

15. A method according to claim 14, wherein a position of said shield support frame (10) with respect to the introduction of advance support forces is determined from said convergence parameters and/or the inclination of said top canopy in the direction of movement.

16. A method according to claim 1, wherein acceleration sensors are provided as said inclination sensors, and wherein said acceleration sensors detect an angular position of said acceleration sensor in space via a deviation from acceleration due to the gravity.

17. A method according to claim 16, wherein to eliminate errors caused by vibrations of the components being used, the measured values ascertained by said acceleration sensors are checked and corrected by means of a suitable damping method.

18. A method according to claim 1, wherein a position of said shield support frames (10) is made optically visible in a display unit.

19. A method according to claim 18, wherein deviations from predetermined target data values that are recognized as forming a risk are illustrated in a conspicuous color in said display unit.

* * * * *